US006431393B1

(12) United States Patent
Stewart

(10) Patent No.: US 6,431,393 B1
(45) **Date of Patent: *Aug. 13, 2002**

(54) STORAGE DEVICE WITH CLOSURE

(75) Inventor: John Stewart, London (GB)

(73) Assignee: Worlds Apart Limited, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,755

(22) Filed: Nov. 22, 1999

(30) Foreign Application Priority Data

Nov. 24, 1998 (GB) ..... 9825586

(51) Int. Cl.[7] ..... B65D 51/04

(52) U.S. Cl. ..... 220/826; 220/830; 220/833; 220/845; 220/847; 220/490; 220/324; 220/213; 220/9.2

(58) Field of Search ..... 220/826, 9.1, 9.2, 220/9.3, 9.4, 490, 213, 252, 287, 315, 324–326, 810, 817, 822, 827, 830, 833, 845, 847, 731, 823, 828, 829, 485, 489, 493; 135/88.07, 88.14, 88.16, 88.3, 98, 123, 143, 124, 125, 126, 128, 132, 133; 160/352, 356, 84.01, 84.07, 36; 150/120, 130; 383/2, 42, 7, 61, 62, 119

(56) References Cited

U.S. PATENT DOCUMENTS

| | | | | | |
|---|---|---|---|---|---|
| 540,807 | A | * | 6/1895 | Andrews | 220/252 |
| 1,007,829 | A | * | 11/1911 | Westbrook | 135/133 |
| 1,143,774 | A | * | 6/1915 | Nichlolls | |
| 1,233,117 | A | * | 7/1917 | Parker | 220/9.2 |
| 1,779,159 | A | * | 10/1930 | Coe | 220/666 |
| 2,080,786 | A | * | 5/1937 | Robles | 220/252 |
| 2,250,739 | A | * | 7/1941 | Smith | 220/252 |
| 3,014,516 | A | * | 12/1961 | Mueller | 220/9.2 |
| 3,732,909 | A | * | 5/1973 | Rooke et al. | 220/793 |
| 3,802,450 | A | * | 4/1974 | Huddle | |
| 3,831,650 | A | * | 8/1974 | Consorti | 383/7 |
| 3,848,615 | A | * | 11/1974 | Warner et al. | 135/132 |
| 4,116,206 | A | * | 9/1978 | Warner et al. | 135/88.13 |
| 5,010,939 | A | * | 4/1991 | King | 160/84.07 |
| 5,139,070 | A | * | 8/1992 | Kidd | 160/84.07 |
| 5,439,017 | A | * | 8/1995 | Brown | 135/126 |
| 5,542,560 | A | * | 8/1996 | Gerster et al. | |
| 5,625,982 | A | * | 5/1997 | Foote | 52/64 |
| 5,964,533 | A | | 10/1999 | Ziglar | |

FOREIGN PATENT DOCUMENTS

| | | | | |
|---|---|---|---|---|
| FR | 2635754 | * | 3/1990 | 383/2 |

* cited by examiner

*Primary Examiner*—Lee Young
*Assistant Examiner*—Robin Hylton
(74) *Attorney, Agent, or Firm*—Head, Johnson and Kachigian

(57) ABSTRACT

A storage device (2) comprising a resilient frame (6) held in a housing with respect to sheet material, the resilient frame (6) and sheet material forming the sidewalls (4) of the device (2). The resilient frame (6) is movable between a flattened condition in which the resilient frame (6) is compressed and an erected condition to which the resilient frame (6) is biased. At one end of the device there is provided a base (8) and at the other end there is provided an opening (10) with closure means 11. The closure means (11), when moved to a closed position in one embodiment extend away from the opening and in all embodiments do not require any storage space in the device to be left unused.

11 Claims, 10 Drawing Sheets

STORAGE DEVICE WITH CLOSURE

CROSS-REFERENCE TO RELATED APPLICATIONS

This application claims priority to G.B. Application No. 9825586.2 filed Nov. 24, 1998.

BACKGROUND OF THE INVENTION

The invention, which is the subject of this application, relates to a storage device of the sort in which articles such as clothing, toys, sporting articles and the like can be stored and retained in one place.

Conventional storage devices are commonly available and come in many forms such as toy chests, blanket boxes made of wood and storage baskets and containers made of plastics material and are self standing so as to be available for use readily. The conventional self standing device, in whichever form, has the disadvantage of becoming part of the furniture of a premises and in many instances the storage device can be unsightly and is required to be accommodated in the premises even when it is not in use. Furthermore the conventional free standing storage devices are bulky and can encroach onto the available floor area which is particularly noticeable in smaller rooms such as bed rooms, bathrooms and the like. The devices can also in certain instances represent a hazard, especially to children however they are regarded as being necessary in order to keep articles like toys, clothing and the like in one place.

It is known to provide storage devices which are free standing in use and can also be moved to a collapsed condition when not in use so as to prevent the same from taking up space when not in use. These devices can be moved between a collapsed or flattened condition and an erected condition by the provision of a helically wound spring member which is threaded along a helical passage in sheet material so that the sheet material forms the side wall of the storage device and the spring, when in its expanded condition, forms the device into an erected condition. Movement of this spring to a flattened condition or compressed condition causes the storage device to move to a collapsed condition. In the known device an opening is required to be provided to provide a funnel effect so that when an article is placed on the opening to be put into the device, the opening means protrude inwardly of the device. This therefore means that a substantial area of the available storage space within the device cannot be used as it is required to be left free for the protrusion inwardly of the opening means as, if this space was filled by articles then the opening means will not be able to extend inwardly to the required amount and so the opening means will not function correctly as a funnel.

SUMMARY OF THE INVENTION

The aim of the present invention is to provide improvements to the collapsible storage device which improve the utility of the device and allow improved use of the storage space within the device.

In a first aspect of the invention there is provided a storage device, said storage device comprising a resilient frame and sheet material with respect to which the frame is located, said resilient frame and sheet material forming the side walls of the device and movable between a flattened condition and an erected condition to which the resilient frame is biased and at one end of the device there is provided a base and at the other end there is provided an opening and characterised in that the opening is provided with closure means relatively movable to a closed position in which the closure means extends upwardly and away from the opening.

In one embodiment the closure means comprises two elements, said elements pivotally movable apart to an open position to allow articles to be placed into and removed from the device.

In one embodiment the two opening elements are pivotally movable towards each other about separate pivot points. Alternatively the two opening elements are pivotally movable towards each other about a common point. In addition, a grommet or rubber band can be used to retain the opening elements in position.

In one embodiment the two opening elements have leading edges provided with resilient portions which allow the two opening elements to be pivotally movable towards each other to a closed position and apart to an open position. The resilient portions can be in the form of a spring or a rubberised section.

In one embodiment the two opening elements extend upwardly from the edge of the sidewalls so that, when closed the portions are positioned above the edge of the opening, and when open they lie in substantially the same plane as the opening. The provision of the opening means as described ensures that all of the storage device area defined between the plane of the opening and the base is available for the storage of articles therein.

Preferably the two opening elements are held together in the closed position by retaining means.

In one embodiment the opening means comprise a number of rigid vanes which are attached at spaced intervals to sheet material which follows the movement of the pivotal action of the opening means between open and closed positions.

As an alternative to the closure comprising two elements it can, for example comprise one element which has a first part attached to one side of the opening and a leading edge which can be moved about a pivotal point between a position at the said one side of the opening so that the storage device is open and a position at or in contact with the other side of the opening to close the opening.

In which ever embodiment it is envisaged that this form of closure will provide for a dome shaped closure when the same is in the closed position.

In a second aspect of the invention, there is provided a collapsible storage device comprising a resilient frame and sheet material with respect to which the frame is located, said resilient frame and sheet material forming the side walls of the device and movable between a flattened condition and an erected condition to which the resilient frame is biased and at one end of the device there is provided a base and at the other end there is provided an opening with closure means which comprises sheet material with retaining means around the periphery and which allows the closure periphery to be placed around the opening of the storage device to close the opening and to gain access to the opening by at least partially removing the material.

This form of storage device again allows all of the storage area to be used for the storage of articles therein.

In one embodiment, the closure means is attached to the device at at least one point to avoid the tendency for the closure means to be removed from the device and then discarded or lost.

In an alternative embodiment the opening means is attached to the device along a substantial portion of the periphery of the device so that a portion of the opening means can be moved between open and closed positions.

In a further feature of the invention there is provided a storage device, said storage device including a resilient frame to which is attached sheet material, said resilient frame and sheet material forming the side wall of the device and wherein the resilient frame is attached to the sheet material on the inner face of the sheet material so as to allow the external surface of the sheet material to be available for printed matter to be applied thereto and displayed in an uninterrupted manner.

Typically the resilient frame is attached to the internal surface of the sheet material within a housing formed of sheet material which, in addition to attaching the resilient frame, forms the same into a helical spring formation which allow the frame and the storage device to be collapsible.

Conventionally, the resilient frame means is located on the external surface and/or strengthening ribbing has been attached on the external surface of the sheet material at the location of the resilient frame means and this means that only the portions of the sheet material between the locations of the resilient frame means has been available for the printing of material thereon. This has been found to detract to a significant extent from the utility and attractiveness of the device as no substantial printed material can be applied to the external surface to give any significant effect and it is submitted that the invention of this aspect of this application greatly improves the utility of the device.

Typically the resilient frame is formed of spring steel or other suitable elongate member material.

In a yet further embodiment, the opening means can be defined by a moulded or otherwise formed article, which article can be formed to provide a visual effect which may add to the visual affect created by the addition of the printed matter to the side wall.

In one embodiment of the invention, the storage device comprising a base, side walls mounted with a resilient frame and an opening means is used as a play device by children and to improve the safety of the device at least one aperture is provided in the sidewalls and/or base of the device.

Typically, a number of apertures are provided and preferably in the base of the device so as to improve ventilation into the interior of the device without affecting the appearance of the same.

Preferably the sheet material comprises any suitable material such that for example the base may be made from a waterproof material to prevent leakage into the goods held in the device. The sheet material can also be made from fire retardant material to meet the relevant safety standards.

BRIEF DESCRIPTION OF THE DRAWINGS

The side walls of the storage device preferably define a cylindrical storage device.

Specific embodiments of the invention will now be described with reference to the accompanying drawings, wherein.

DETAIL DESCRIPTION OF THE PREFERRED EMBODIMENT

Figure 1A:
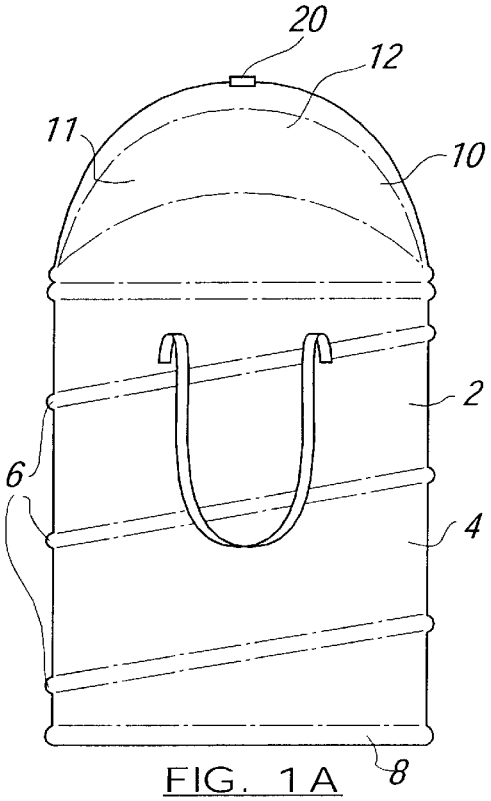
FIGS. 1A to 1F illustrate a storage device according to the invention with an opening means in one embodiment of the invention.

Referring firstly to FIGS. 1A–1F and 2A–2B, there is illustrated a storage device 2 which comprises side walls 4 in erected condition and which are maintained in the erected condition by a resilient frame means 6. At one end of the side wall 4 there is provided a base portion 8 and at the other end an opening 10 with closure means 11. In this embodiment, the closure means 11 comprise a first portion 12 and second portion 14 which are pivotally movable about pivot points 16, 18 on the storage device. The portions 12 and 14 form an inverted bowl shape or dome shape when in a closed position as shown in FIGS. 1A–1E with the edges of the portions held together by retaining means 20 as shown.

Figure 1B:
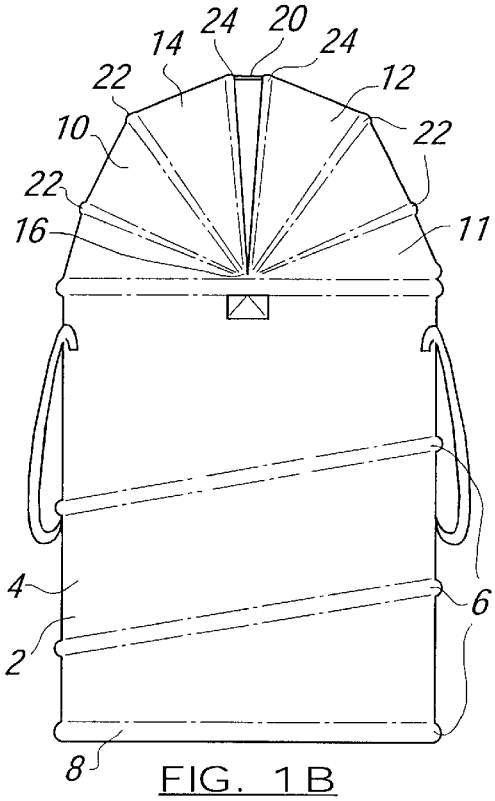
Figure 1C:
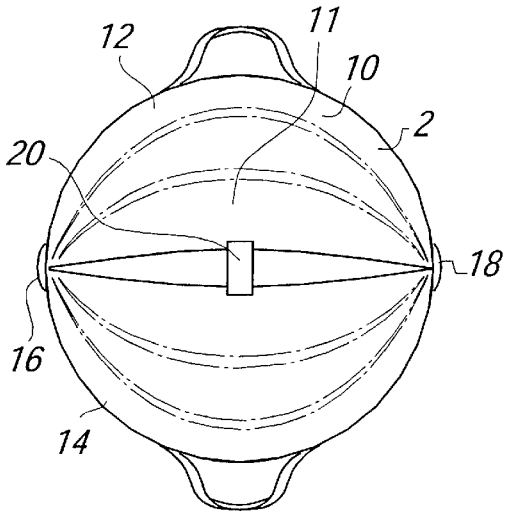
Figure 1D:
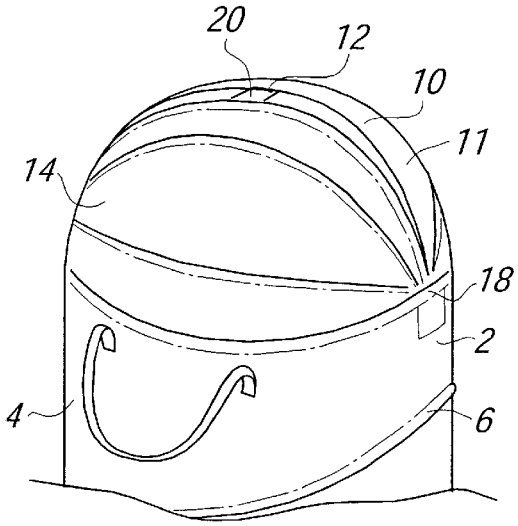
Figure 1E:
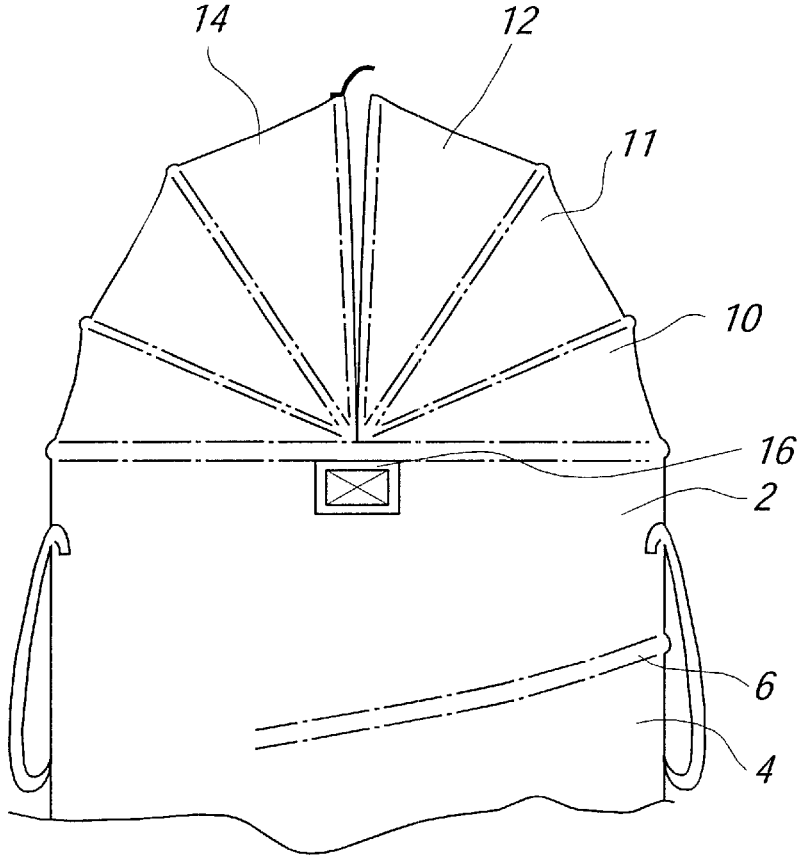
Figure 1F:
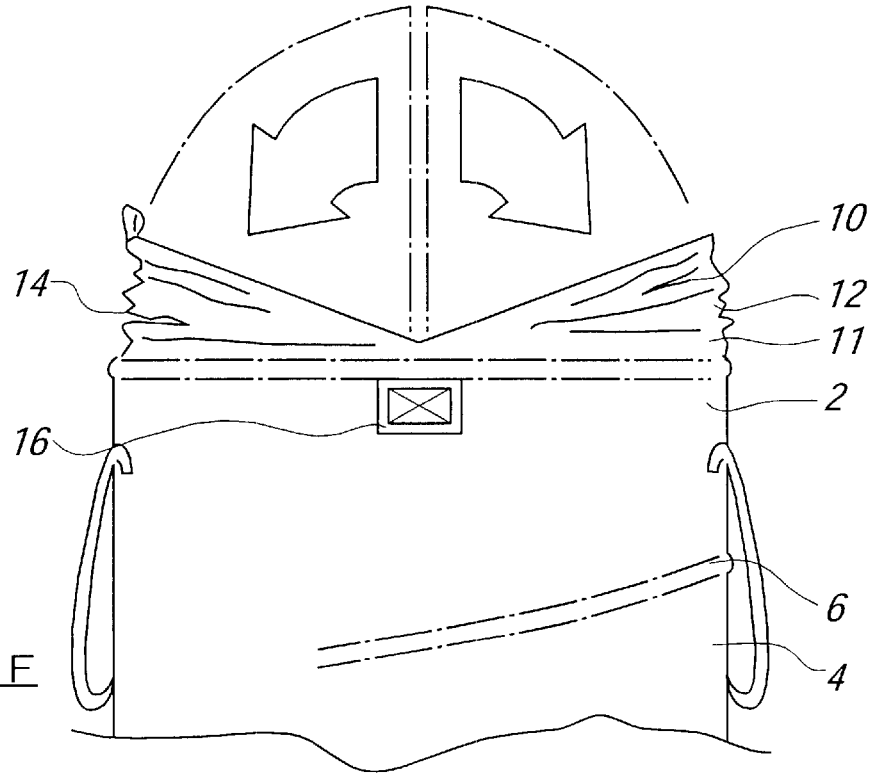

To allow access to be gained to the interior of the storage device, the retaining means 20 are released as shown in FIG. 1E and the portions 12, 14 can be pivotally moved back to lie on the periphery of the storage device sidewall opening as shown in FIG. 1F, and so the entire area of the opening is available for the placement of articles and removal of articles into and from the storage device interior. It will also be appreciated that as the opening means 10 depend upwardly from the ends of the sidewalls, so the entire interior of the storage device defined by the side walls and base is available for the storage of articles. The requirement of operation of the opening means does not restrict the available area as in conventional devices.

Figure 2A:
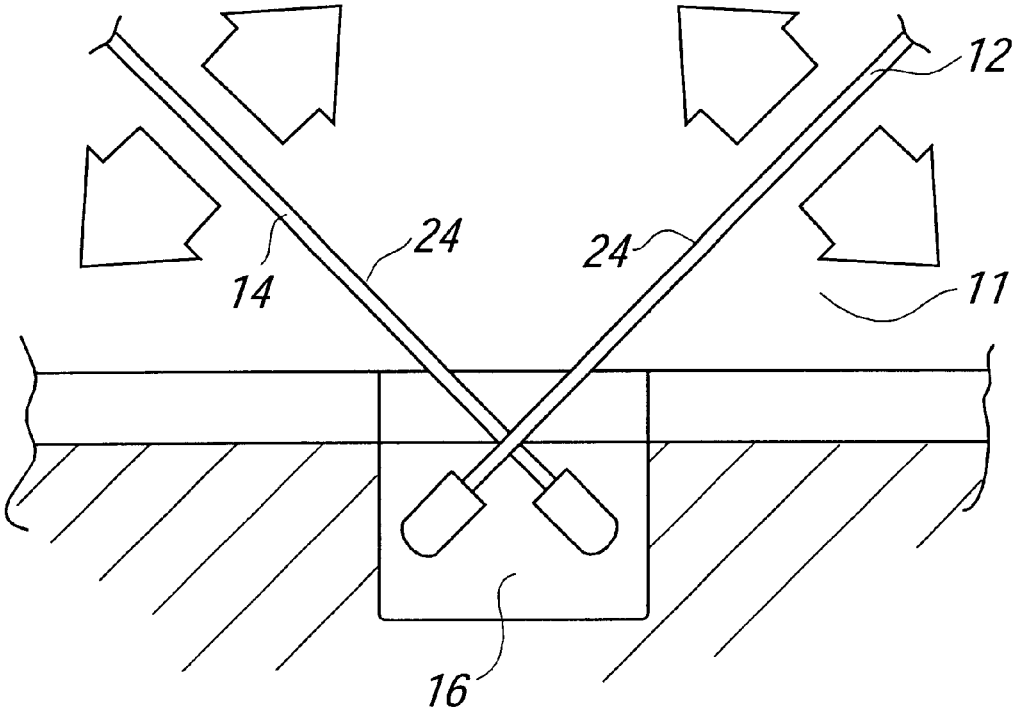
FIGS. 2A–2D illustrate various embodiments of the pivoting detail of the opening means of FIGS. 1A–1F.
Figure 2B:
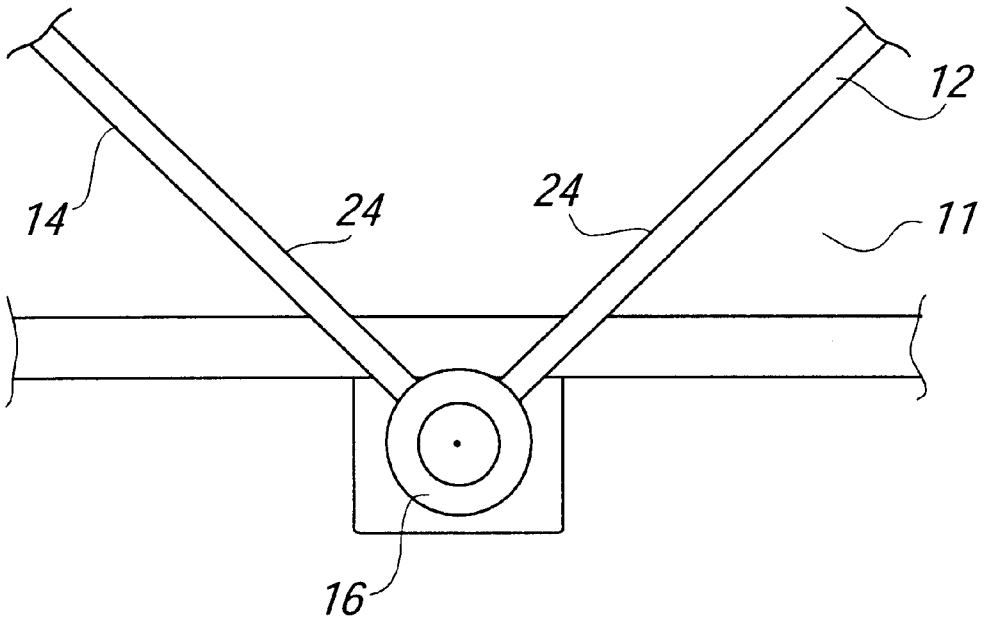

FIGS. 2A–2D illustrate alternative pivot point arrangements. In FIG. 2A each of the portions 12, 14 is separately pivotally movable by movement of the leading vanes 24 as shown and in FIG. 2B the leading vanes of the portions 12, 14 are pivotally movable about a common point 16 as shown.

Figure 2C:
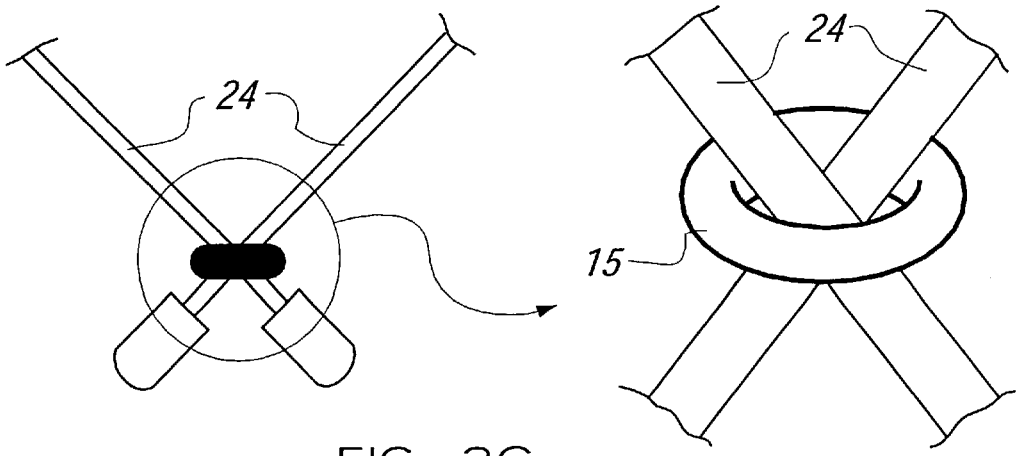
Figure 2D:
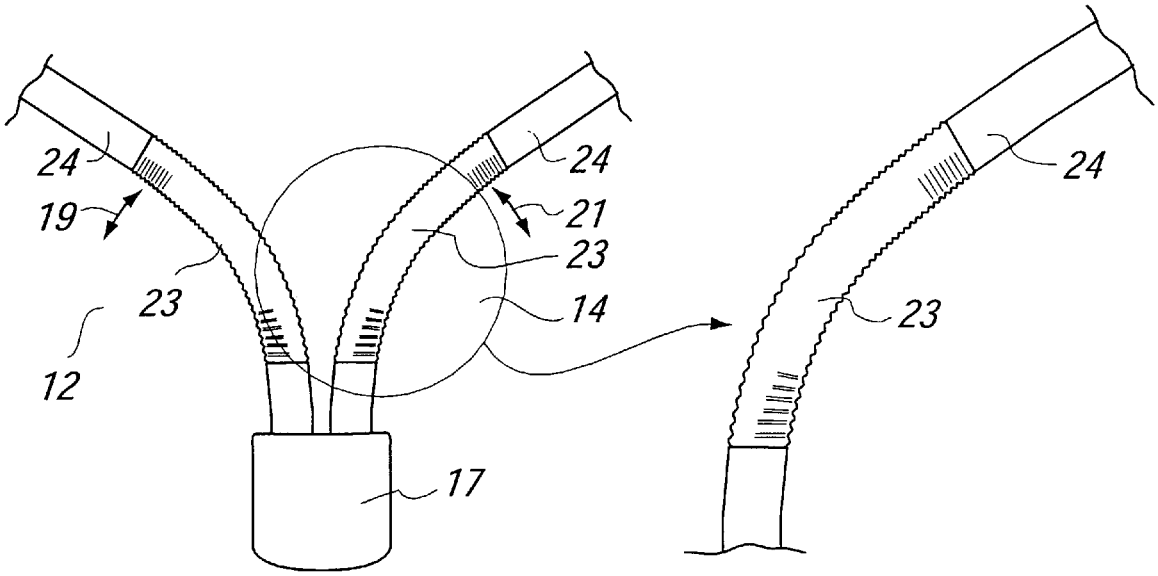

FIG. 2C illustrates a variation on FIG. 2A where there is shown a connecting means 15 in the form of a grommet or rubber band which retains the leading vanes 24 in relationship. FIG. 2D illustrates a further embodiment wherein each of the leading vanes 24 for the portions 12, 14 is provided with a resilient portion 23 in the form of a spring or rubberised section and which allows the vanes to be movable about a support 17 as shown by arrows 19, 21 between the open and closed positions.

The portions 12 and 14 are formed from a number of relatively rigid vanes 22 as shown in FIG. 1B, which are attached at spaced intervals to sheet material and which follows the movement of the pivotal action of the leading vanes 24 between open and closed positions. Although shown in relation to a cylindrical storage device, it should be appreciated that this type of opening can be provided in appropriate shape to match the cross section of the storage device.

Figure 3B:
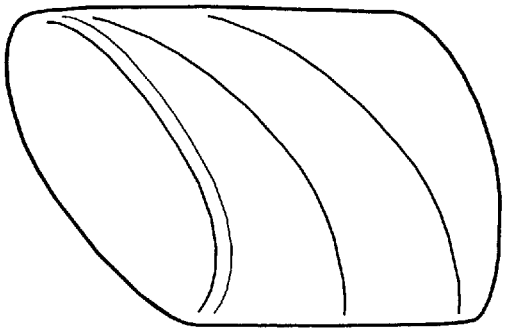
FIGS. 3A to 3S illustrate further alternative embodiments and uses of the storage device according to the invention.
Figure 3D:
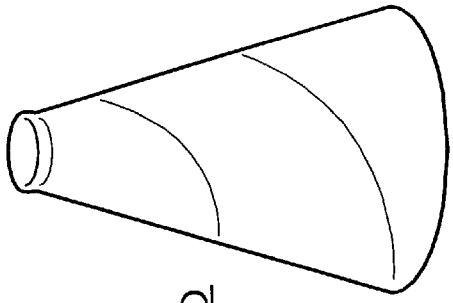
Figure 3C:
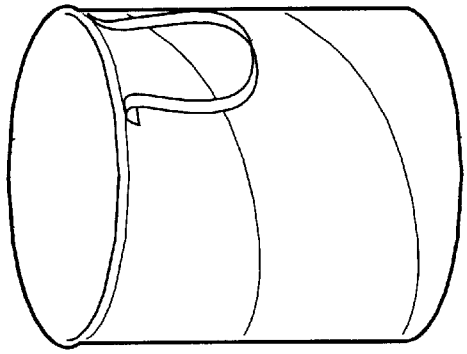
Figure 3A:
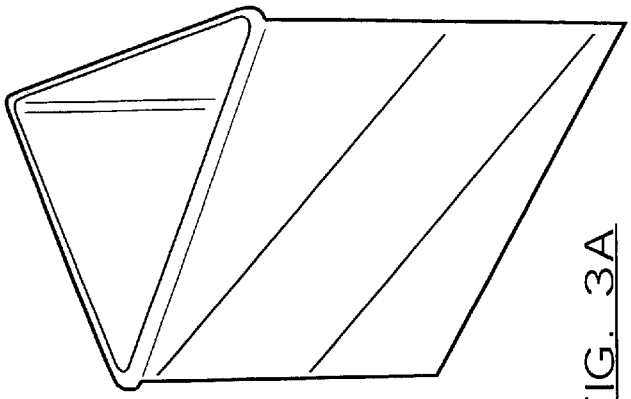
Figure 3E:
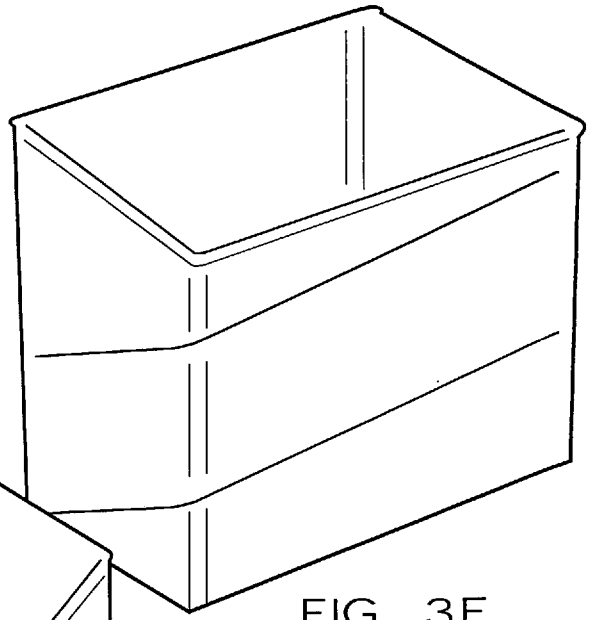
Figure 3F:
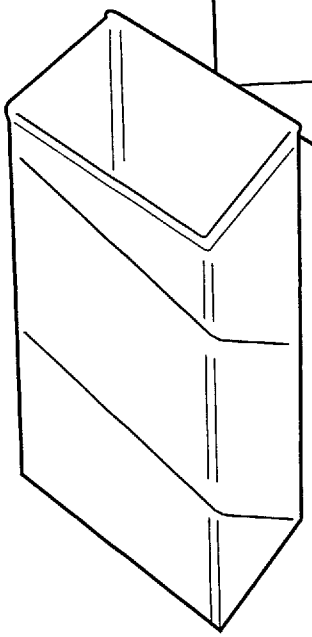
Figure 3G:
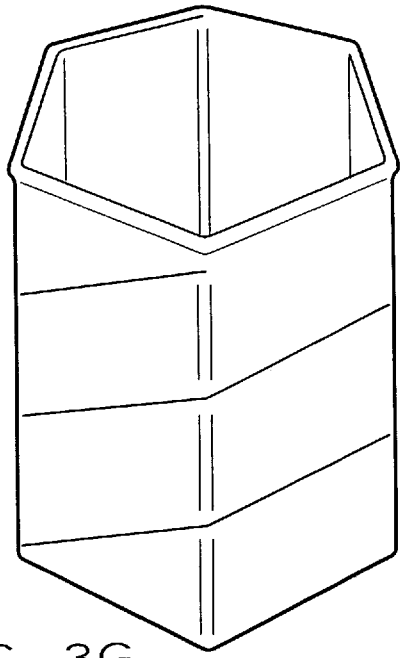
Figure 3H:
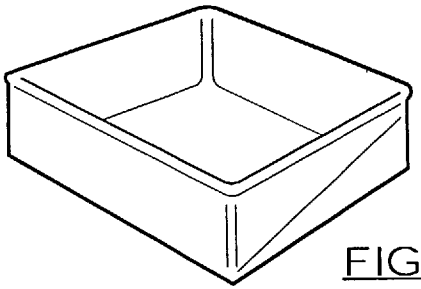
Figure 3I:
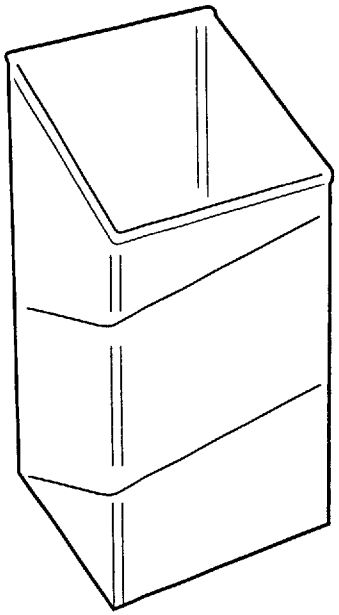
Figure 3L:
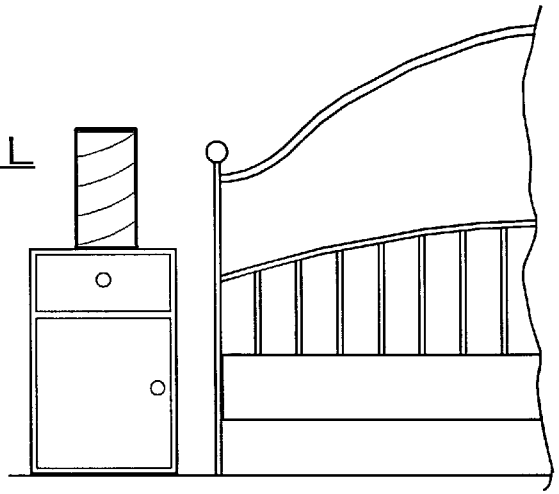
Figure 3K:
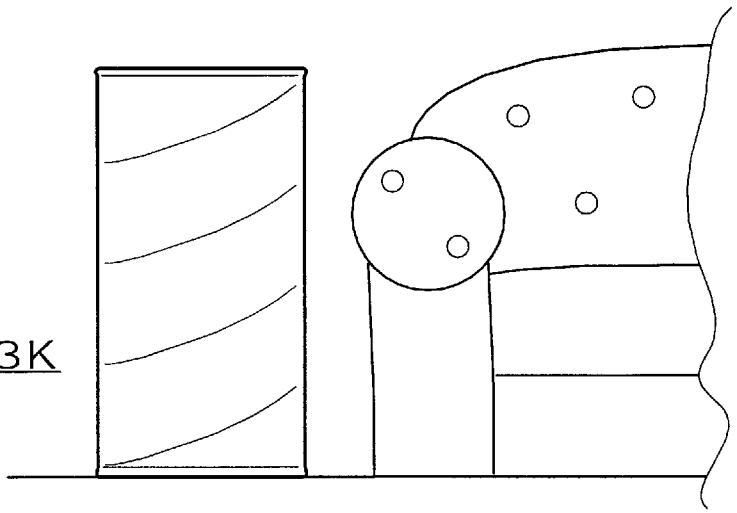
Figure 3J:
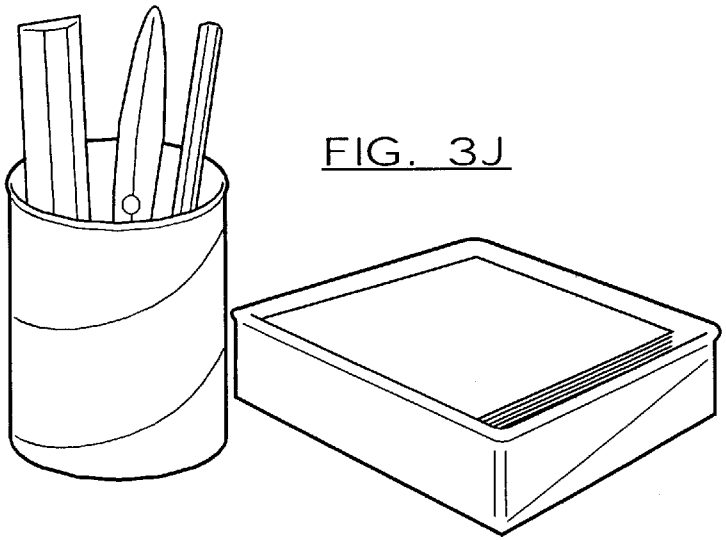
Figure 3P:
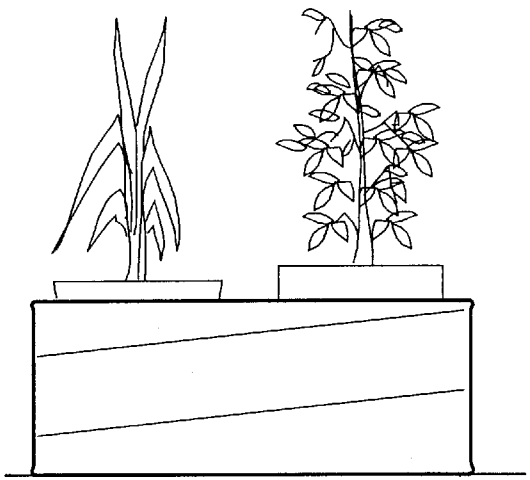
Figure 3M:
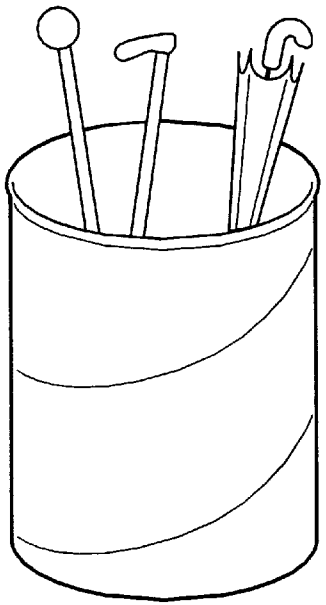
Figure 3N:
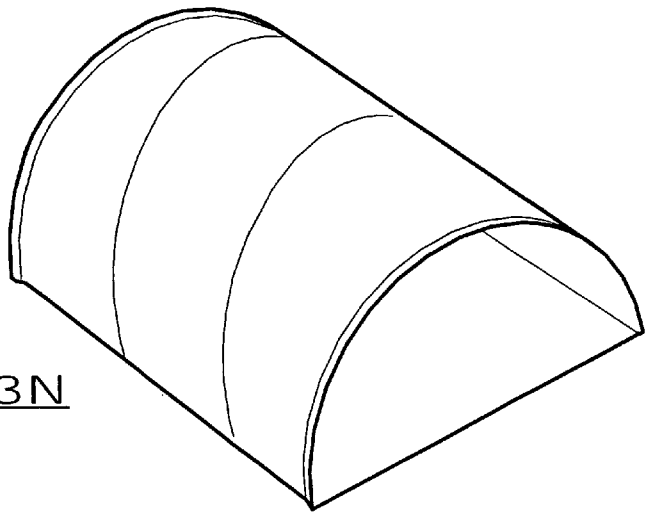
Figure 3Q:
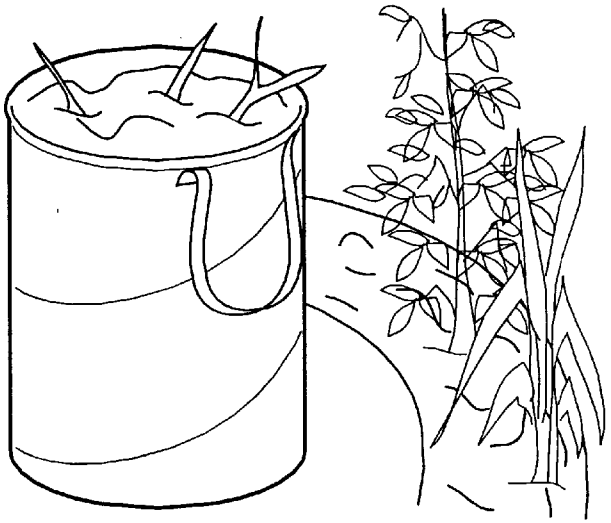
Figure 3S:
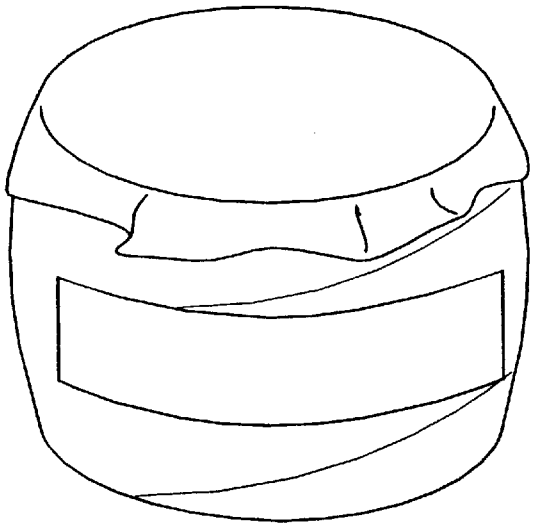
Figure 3R:
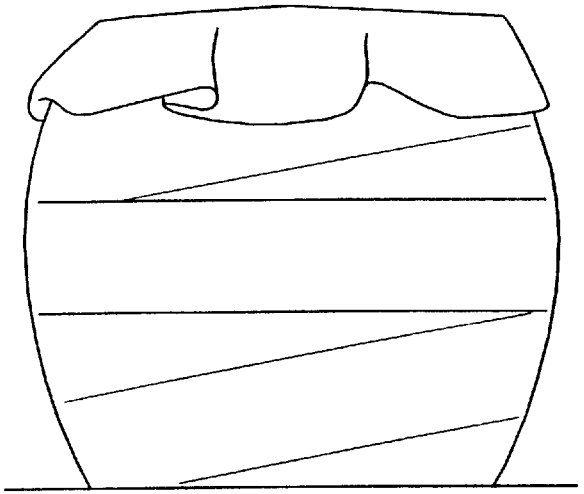

FIGS. 3A–3I illustrate various shapes of the storage device which can be formed using the concept of this invention. FIGS. 3J–3Q illustrate possible uses of a storage device formed in accordance with this invention and it should be appreciated that reference to storage device should also include the lighting uses shown in FIGS. 3K and 3L. The remaining devices are all used for storage in some form or other. FIGS. 3R–3S illustrate a further embodiment and illustrate how the printed matter applied to the surface of the side walls can be used in conjunction with the shaping of the device to enhance the visual effect created, with, in this case, the storage device and printing depicting a honey pot of the type clearly identified with WINNIE THE POOH and in this case the opening is a sheet of material removably attached around the periphery of the opening.

Figure 4:
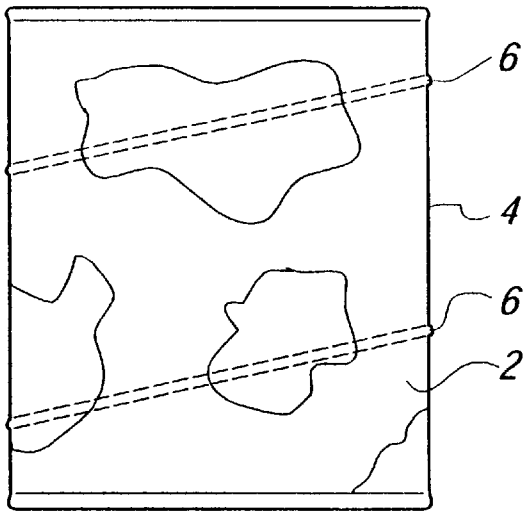
FIG. 4 illustrates a further aspect of the invention.

FIG. 4 illustrates a further aspect of the invention and shows a storage device with printed matter across the entire external wall of the device. This is possible as the resilient member is engaged in a passage which is of a helical form as shown by the stitching in broken lines said passage is formed on the interior surface of the side wall. This therefore means that firstly the passage is hidden from view externally, secondly that the entire external surface is available for the application of printed matter thereon and, thrirdly, that any strengthening material which is typically applied is applied to the interior surface again leaving the entire external surface available for the printing of material thereon and which has not previously been possible.

Figure 5A:
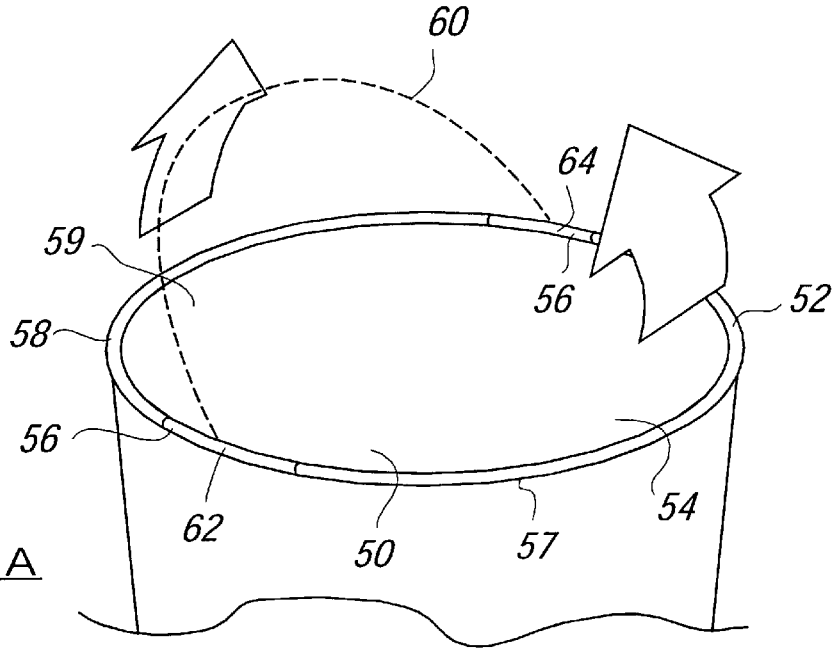
FIGS. 5A–5C illustrate a further embodiment of an opening means for the invention.
Figure 5B:
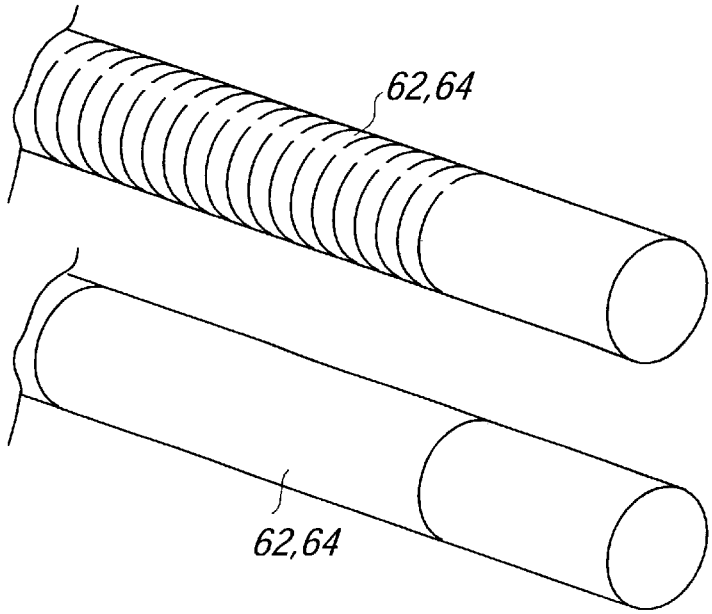
Figure 5C:
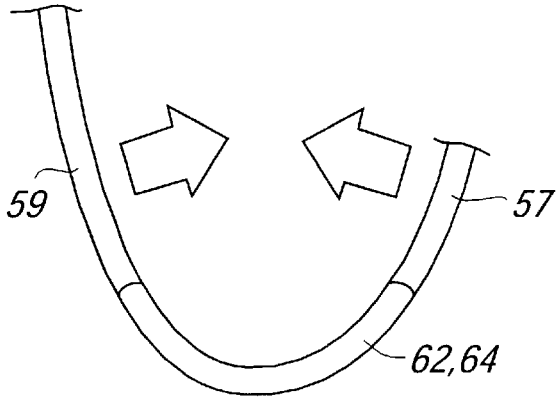

Referring now to FIGS. 5A–5C there is illustrated a further form of opening means which comprises a lid 50 formed from a ring frame of say sprung steel, glass fibre etc 52 which supports sheet material 54 therebetween, and is attached about portions 56 of the periphery to the device opening. On each side 57, 59 of these portions the remainder of the lid is movable between closed and open positions.

FIG. 5A illustrates how the portion 59 can be moved between a closed position 58 and an open position 60, as shown in broken lines, with pivotal movement about the portions 56 which include resilient sections 62, 64. The resilient sections can be formed of a spring or rubber material as shown in FIG. 5B and can be bent as illustrated in FIG. 5C to allow the portions of the lid 57, 59 to be moved to open positions as shown.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A collapsible storage device (2), said storage device comprising a resilient frame (6) and sheet material with respect to which the frame is located, said resilient frame and sheet material forming the side walls (4) of the device and movable between a completely flattened condition and an erected condition to which the resilient frame is biased and at one end of the device there is provided a base (8) and at the other end there is provided an opening (10) and characterised in that the opening is provided with two closure elements (12, 14) completely flattened in the open position and wherein said elements are movable towards each other to a closed position in which the elements engage, and wherein a portion of each closure element extends upwardly and away from the opening.

2. A collapsible storage device (2) according to claim 1 wherein said two closure elements (12, 14) extend upwardly from the edge of said side walls (4) so that, when closed said elements (12, 14) are positioned above the edge of said opening (10), and when open said elements lie in substantially the same plane as the opening.

3. A collapsible storage device (2) according to claim 1 wherein said two closure elements (12, 14) are pivotally movable towards each other about separate pivot points.

4. A collapsible storage device (2) according to claim 1 wherein said two closure elements (12, 14) are pivotally movable towards each other about a common pivot point.

5. A collapsible storage device (2) according to claim 1 wherein said each closure element is retained to position by a grommet or rubber band (15) located at or adjacent the pivot points.

6. A collapsible storage device (2) according to claim 1 wherein said two closure elements (12, 14) have leading edges which are provided with resilient portions (23) which allow said two opening elements (12, 14) to be pivotally movable toward each other to a closed position and apart to an open position.

7. A collapsible storage device (2) according to claim 6 wherein said resilient portion (23) is in the form of a spring.

8. A collapsible storage device (2) according to claim 6 wherein said resilient portion (23) is a rubberised section.

9. A collapsible storage device (2) according to claim 1 wherein said two closure elements are held in the closed position by retaining means (20).

10. A collapsible storage device according to claim 1 wherein said in closed position, said two closure elements form a dome and extends upwardly from the opening defined by the edge of said side.

11. A collapsible storage device (2) according to claim 1 wherein said each said two closure elements comprises a number of relatively rigid members (22) attached at spaced intervals to sheet material which follow the movement of the pivotal action of the each said two closure elements between open and closed positions.

* * * * *